US007163495B2

(12) United States Patent
Fazio et al.

(10) Patent No.: US 7,163,495 B2
(45) **Date of Patent: *Jan. 16, 2007**

(54) BREAST ENHANCEMENT SYSTEM

(75) Inventors: Reneé S. Fazio, Gulfport, FL (US); Jeff Tuller, Indian Wells, CA (US)

(73) Assignee: Genevieve M. Griffin, Orlando, FL (US)

( * ) Notice: Subject to any disclaimer, the term of this patent is extended or adjusted under 35 U.S.C. 154(b) by 486 days.

This patent is subject to a terminal disclaimer.

(21) Appl. No.: 10/245,733

(22) Filed: Sep. 17, 2002

(65) Prior Publication Data

US 2003/0017920 A1 Jan. 23, 2003

Related U.S. Application Data

(63) Continuation-in-part of application No. 09/006,692, filed on Jan. 13, 1998, now Pat. No. 6,468,190, which is a continuation-in-part of application No. 08/646,493, filed on May 8, 1996, now Pat. No. 5,735,780.

(51) Int. Cl.
*A63B 21/008* (2006.01)

(52) U.S. Cl. ..... 482/112; 482/62; 482/111

(58) Field of Classification Search ..... 482/111, 482/62, 112, 114, 148; 623/8; 124/65, 33; 425/352; D21/691–2
See application file for complete search history.

(56) References Cited

U.S. PATENT DOCUMENTS

| | | | | | |
|---|---|---|---|---|---|
| 767,008 | A | * | 8/1904 | Monier | 482/112 |
| 2,806,699 | A | | 9/1957 | Spooner | |
| 3,471,145 | A | * | 10/1969 | Berger | 482/112 |
| 3,497,216 | A | | 2/1970 | Feather | |
| 3,834,696 | A | * | 9/1974 | Spector | 482/112 |
| 3,955,655 | A | * | 5/1976 | Pornin | 188/313 |
| 4,290,599 | A | * | 9/1981 | Berger | 482/112 |
| 4,483,533 | A | | 11/1984 | Mangiapane | |
| 5,026,050 | A | | 6/1991 | Leung et al. | |
| 5,044,630 | A | * | 9/1991 | Ventimiglia | 272/130 |
| 5,246,413 | A | | 9/1993 | Koblick | |
| 5,267,929 | A | | 12/1993 | Chen | |
| 5,529,559 | A | * | 6/1996 | Punzalan | 482/112 |
| 5,735,780 | A | * | 4/1998 | Fazio et al. | 458/112 |
| 6,468,190 | B1 | * | 10/2002 | Fazio et al. | 482/112 |

* cited by examiner

*Primary Examiner*—Lori Amerson
(74) *Attorney, Agent, or Firm*—Patton Boggs LLP

(57) ABSTRACT

A chest exerciser includes an elongated plunger housing and a pair of plungers that move in sealed sliding contact with the plunger housing on opposite sides of a common air volume within said plunger housing. An adjustable vent, centrally located between the plungers, communicates with the common air volume. Each plunger is attached to a hand grip. The handles slide on and are coaxial with the plunger housing. In the fully retracted position the grip distance between the proximal end of said first plunger hand grip member and the proximal end of said second plunger hand grip member is between 0 and 10 inches. The exerciser is used in combination with a breast enhancement nutrient, such as pueraria mirifica, which may be applied to the breast as a cream or tonic or ingested as an herb or pill.

17 Claims, 12 Drawing Sheets

1
8
9
4
2
10
3
2
10
3

1
8
5
9
2
10
3
2
10
3

1
8
6
6A
9
2
11
10
3
2
10
3
11A 1
8
7
7A
9
2
11
10
3
10
2
11
3
11B
11C

FIG. 5
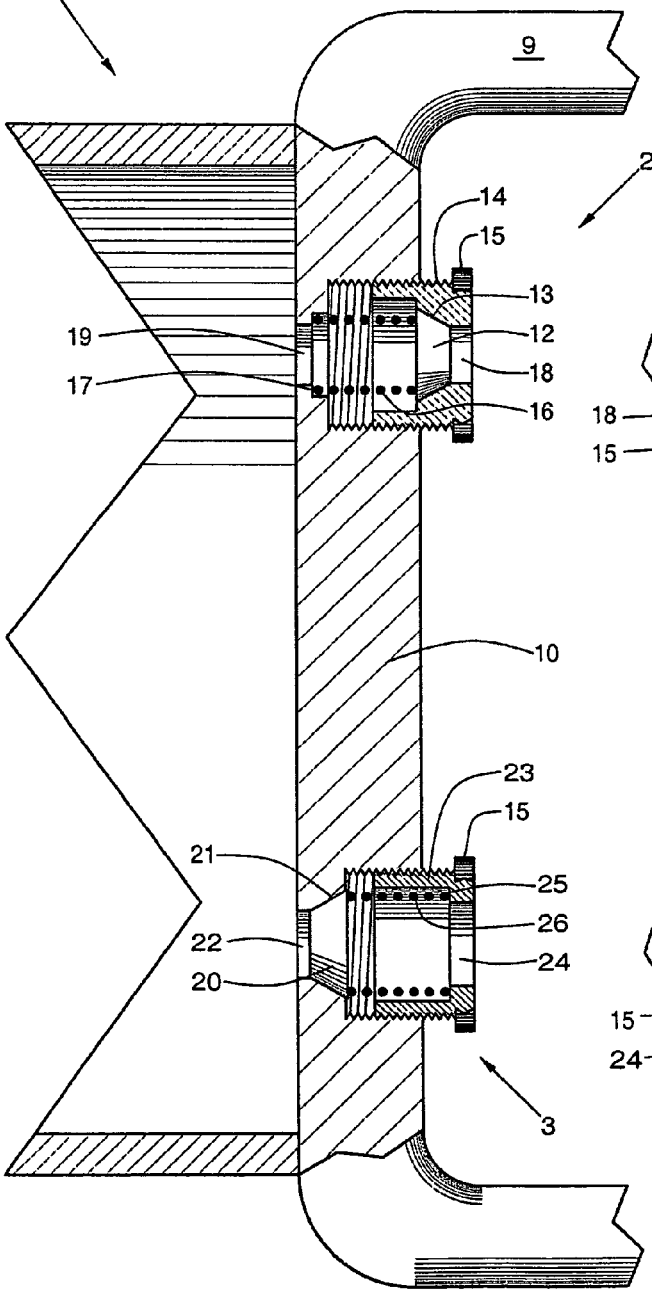
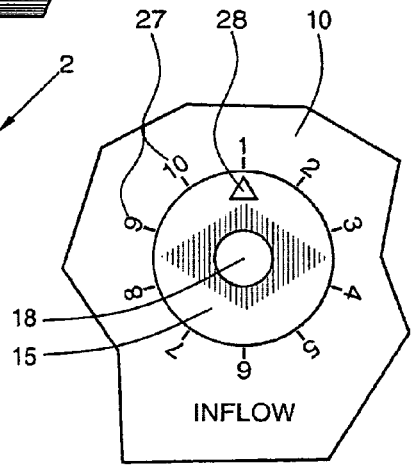
FIG. 6
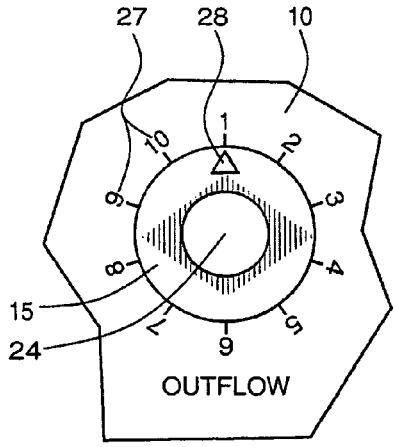
FIG. 7

FIG. 8
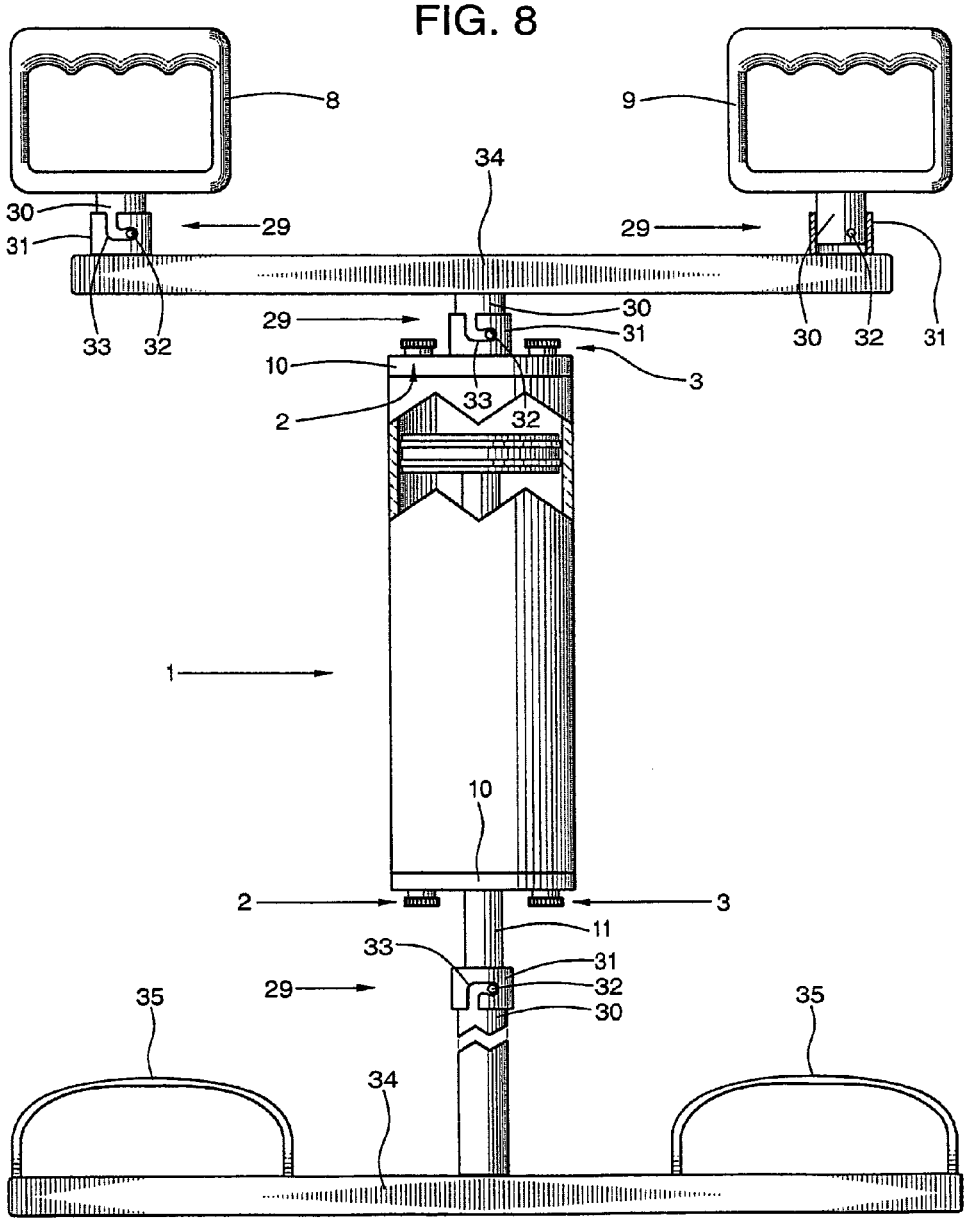
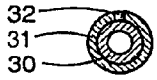
FIG. 9

BREAST ENHANCEMENT SYSTEM

CROSS-REFERENCE TO RELATED APPLICATION

This application is a continuation-in-part of application Ser. No. 09/006,692 filed on Jan. 13, 1998, now U.S. Pat. No. 6,468,190, which is a continuation-in-part of application Ser. No. 08/646,493 filed May 8, 1996, now U.S. Pat. No. 5,735,780.

BACKGROUND OF THE INVENTION

This invention relates to exercising devices and in particular to a pneumatic resister of linear motion having a selection of handle, attachment and/or anchor means that are positional on opposite ends for direction of selectively push exercise and pull exercise to select muscle groups and to specific muscles in the select muscle groups.

A wide variety of motion resisters have been devised for expending exercise work to build muscles. None are known, however, to be pneumatic motion resisters having equally or selectively variable opposite-directional motion resistance with select handle, attachment and/or anchor means positional on opposite ends in a manner taught by this invention.

Examples of spring exercise devices that are related but different are described in the following patent documents: U.S. Pat. No. 5,267,929, issued to Chen on Dec. 7, 1993; U.S. Pat. No. 5,246,413, issued to Koblick on Sep. 21, 1993; U.S. Pat. No. 5,026,050, issued to Leung, et al. on Jun. 25, 1991; U.S. Pat. No. 4,483,533, issued to Mangiapane on Nov. 20, 1984; U.S. Pat. No. 3,497,216, issued to Feather on Feb. 24, 1970; and U.S. Pat. No. 2,806,699, issued to Spooner on Sep. 17, 1957. Unfortunately, spring-resister type exercise devices are not as safe as pneumatic-resister type exercise devices as skin can get caught between spring coils and the spring device can open quickly and hurt the user.

An example of a different but related pneumatic motion resister is described in U.S. Pat. No. 5,044,630, issued to Ventimiglia on Sep. 3, 1991. The Ventimiglia device, however, was limited to use of elbow pads that specifically direct exercise work to arms instead of to chest and shoulder areas as taught by this invention. Further, the Ventimiglia device was not adaptable to select positioning of handle, attachment and/or anchor means as taught by this invention.

A great need exists for a chest exerciser with which exercise work can be directed precisely to chest muscles. This is important for both women and men. For women, it is because chest muscles make healthy breasts which aid bodily health and do not sag. Instead, muscle at tops and sides of breasts are developed to hold them up, to protect them and to facilitate mammary circulation. Cosmetically, the muscles at tops of breasts cause higher and larger bust configuration. The muscles at sides of breasts add cleavage beauty and breast width that are very attractive. Overall, the breasts can be enlarged with a highly beneficial and safe health effect instead of with breast implants. It also obviates the need for humiliating breast-extension cups.

For men, it is important for some of the same reasons as for women but with different body-structure effects. Development of chest muscles aids circulation in the chest area and looks good. Area-specific exercise of chest muscles causes huge male chest buildup that conveys attractive masculinity in a manner in which similar female chest buildup on breasts conveys attractive femininity.

Improved chest circulation for both women and men also aids circulation in arms and hands. Highly important also, it aids vascular circulation for the heart, the head and the nerves of both sexes.

There is an urgently vast need also for area-specificness of a low-weight, small and inexpensive motion resister to be adaptable and adjustable selectively to exercise of other parts of bodies.

Further yet, there is need for motion resistance with area-specificness to be adjustable separately for opposite directions of linear motion resistance. Resistance of both push and pull provides weight-lifting effects in opposite directions. Some muscle groups and some specific muscles in different muscle groups are best exercised with push and others with pull exertion. Particularly chest group muscles of both females and males have some specific muscles that are best exercised with push and others with pull. Arm and leg muscles are similar in relation to different specific muscles. It is direction of appropriate push and pull exertion to specific muscles in muscle groups that gives the special effects of desired muscle protrusion.

Thus a chest exerciser is adaptable to exercise other muscle groups with precise muscle-area specificity that is effective and efficient for chest buildup of both females and males. One of its utilities is its adaptability of appropriate exertion exercise to different muscle groups and to specific muscles in muscle groups throughout a body as well as to the chest area.

SUMMARY OF THE INVENTION

In light of need for improved exercise devices and methods, objects of this invention are to provide a chest exerciser which:

Is a pneumatic resister of linear motion;

Provides selectively push exercise and pull exercise;

Provides selective levels of push and pull resistance;

Is low-weight, small and inexpensive;

Has selective handle means that are positional on opposite ends for different individual characteristics and for application to different muscles of the chest area; and Has selective attachment and/or anchor means that are positional on opposite ends for different individual characteristics and for application to select muscle groups and to specific muscles of the select muscle groups in a body.

This invention accomplishes these and other objectives with a chest exerciser having a pneumatic resister of linear motion and a selection of handle, attachment and/or anchor means that are positional on opposite ends for direction of selectively push exercise and pull exercise to select muscle groups and to specific muscles in the select muscle groups. The pneumatic resister of linear motion can be a cylindrical pump, a bellows pump, a variously telescopic pump, a resilient pump or other pneumatic pump or combinations of pneumatic pumps. The pneumatic resister of linear motion can be selectively resistant to linear motion by means of flow resisters that can be adjustable of resistance or rate of inflow and outflow of air. Separate inflow and outflow resisters can be provided for adjustment of push and pull exercise. Handle means can be different for different sizes of hands and for different positioning of the pneumatic resister in relation to muscles. Attachment and anchor means can be provided for positioning the pneumatic resister in desired relationship to select muscle groups and to specific muscles in muscle groups of a body.

The invention provides an exercise device comprising: an elongated plunger housing having a first end and second end; a first hand grip member and a first plunger, the first hand grip member connected to the first plunger; and a second hand grip member and an air volume closure member, the second hand grip member connected to the air volume closure member; the first plunger in sealed sliding contact with the plunger housing; a common air volume enclosed by the plunger housing, the first plunger, and the common air volume closure member; the exerciser sized and shaped to be hand-held by an individual for exercising. Preferably, the exercise device further comprises an adjustable vent for venting the plunger housing. Preferably, the air volume closure member is attached to the second end of the elongated plunger housing. Preferably, the adjustable vent comprises a first adjustable vent formed in the air volume closure member. Preferably, the exercise devise further includes a plunger housing first end wall member, the first plunger is connected to the hand grip member via a plunger connector passing through the plunger housing first end wall member, wherein the air volume closure member forms a plunger housing second end wall, and the adjustable vent further includes a second adjustable vent in the plunger housing first end wall member. Preferably, the air volume closure member comprises a second plunger in sealed sliding contact with the plunger housing. Preferably, the second plunger is located on the opposite side of the common air volume from the first plunger.

Preferably, the exercise device includes an elongated plunger housing having a first end and a second end; a first plunger and a first plunger hand grip member, the first plunger hand grip member attached to the first plunger; a second plunger and a second plunger hand grip member, the second plunger hand grip member connected to the second plunger; and the first plunger is in sealed sliding contact with the first end of the plunger housing and the second plunger in sealed sliding contact with the second end of the plunger housing with the first and second plungers opposed on opposite sides of a common air volume within the plunger housing; the exerciser sized and shaped to be hand-held by an individual for exercising.

Preferably the exercise device further includes an adjustable vent for venting the plunger housing. Also preferably, the adjustable vent includes a first adjustable vent for venting the first end of the plunger housing and a second adjustable vent for venting the second end of the plunger housing. Preferably, the adjustable vent communicates with the common air volume. Preferably, the adjustable vent is located centrally to the elongated plunger housing. Preferably, the adjustable vent includes a vent member attached to a knob and a channel communicating with the common air volume, the vent member having a plurality of holes of different sizes, the channel and vent member arranged so that as the knob is turned, a different one of the holes aligns with the channel. Preferably, the first plunger hand grip member and the second plunger hand grip member move relative to each other between a fully extended position and a fully retracted position, and wherein in the fully retracted position the retracted grip distance between the proximal end of the first plunger hand grip member and the proximal end of the second plunger hand grip member is between 0 and 10 inches. Preferably, the retracted grip distance is between 1 and 5 inches. Preferably, the elongated plunger housing comprises two housing members joined by a seal. Preferably, the elongated plunger housing include a vent hole in the elongated plunger housing. Also preferably, the plunger hand grip members each include a plunger hand grip member vent hole.

The invention also provides a method for enhancing the size of a breast comprising: activating a breast growth enhancement compound in the breast of a user; holding with one hand a first hand grip member attached to a first plunger; holding with the other hand a second hand grip member attached to a second plunger, the first plunger opposite the second plunger and in sealed sliding contact in an elongated plunger housing having an adjustable vent for venting the air in the elongated plunger housing; and moving the first plunger and second plunger to move in reciprocating motions relative to each other. Preferably, the activating comprises a process selected from the group consisting of: ingesting herbal foods containing the compound, ingesting pills containing the compound, applying a crème containing the compound to the breast, applying a tonic containing the compound to the breast, and applying a paste containing the compound to the breast.

The invention further provides a method for using a breast enhancement system having: a first hand-held reciprocating member comprising a first proximal end and a first distal end; a second hand-held reciprocating member comprising a second proximal end and a second distal end, wherein first hand-held reciprocating member and the second hand-held reciprocating member being in a fully retracted position, the first proximal end and second proximal end define a retracted gap distance of 0 to 10 inches; and a two-way resistive force member for generating a force that opposes reciprocating movement of the first hand-held reciprocating member and the second hand-held reciprocating member, in response to the reciprocating movement of the first hand-held reciprocating member and the second hand-held reciprocating member; the method comprising: activating a breast growth enhancement compound in the breast of a user; grasping with one hand the first hand-held reciprocating member; grasping with the other hand second hand-held reciprocating member; and moving the first hand-held reciprocating member and second hand-held reciprocating member in reciprocating motion relative to each other. Preferably, the retracted grip distance is between 1 and 5 inches. Preferably, the activating comprises a process selected from the group consisting of: ingesting herbal foods containing the compound, ingesting pills containing the compound, applying a crème containing the compound to the breast, applying a tonic containing the compound to the breast, and applying a paste containing the compound to the breast. Preferably, the compound comprises pueraria mirifica.

In another aspect the invention provides a method for enhancing the size of breasts comprising: applying a breast growth enhancement topical cream to the breasts of a user; holding with one hand a first end of a reciprocating two-ended exercise device; holding with the other hand a second end of the reciprocating two-ended exercise device; stimulating breast enhancement by exerting reciprocating motion by the one hand and the other hand on the reciprocating two-ended exercise device, the two-ended exercise device capable of enabling the one hand and the other hand to be in sufficiently close proximity with each other during a compression stroke of the reciprocating motion to focus exercise on the breast area of the user. Preferably, the topical cream comprises pueraria mirifica.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

FIG. 5 is an exploded fragmentary sectional view of an inflow resister and an outflow resister in relation to an internal periphery of a pneumatic resister of linear motion;

FIG. 6 is a fragmentary top view of an inflow resistor;

FIG. 7 is a fragmentary top view of an outflow resister;

FIG. 8 is a partially cutaway elevation view of a pneumatic resister of linear motion with quick-disconnect attachments for handles and other exercise components;

FIG. 9 is a top view of an alternative quick-disconnect attachment;

DESCRIPTION OF PREFERRED EMBODIMENT

Figure 1:
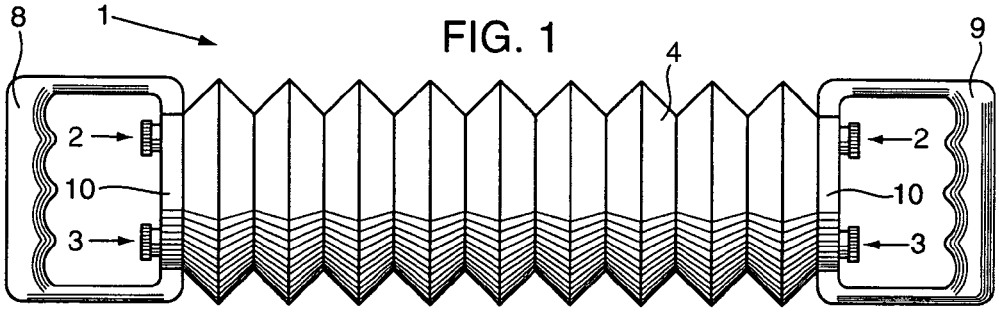
FIG. 1 is a side view of an embodiment with an accordion pneumatic resister of linear motion.
Figure 2:
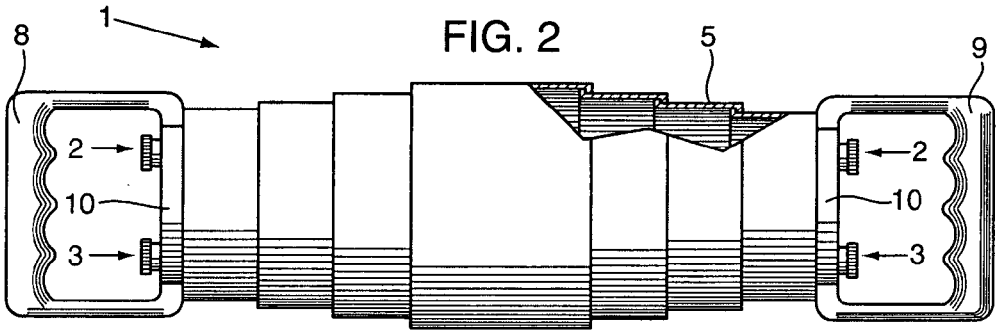
FIG. 2 is a partially cutaway side view of an embodiment with a telescopic pneumatic resister of linear motion.
Figure 3:
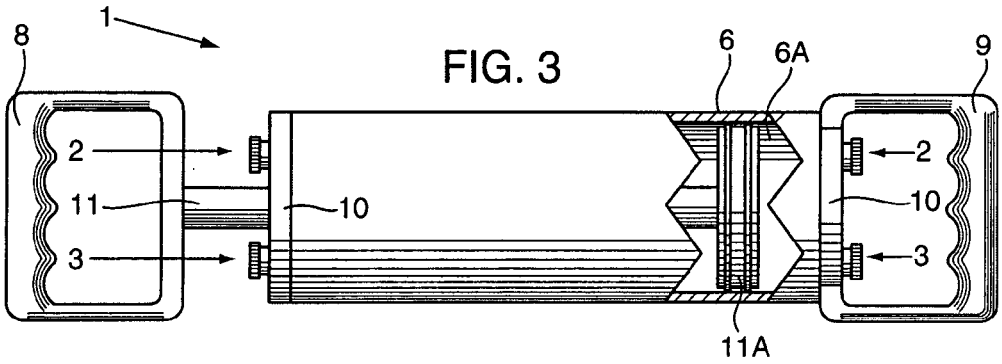
FIG. 3 is a partially cutaway side view of an embodiment with a single-plunger-pump pneumatic resister of linear motion.
Figure 4:
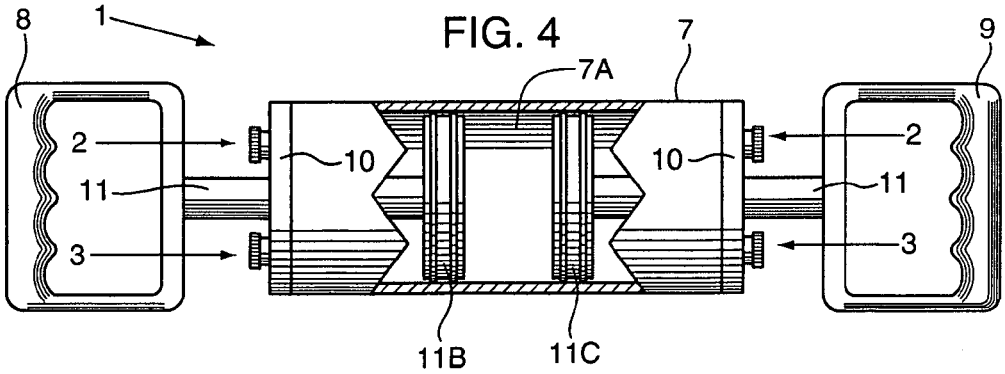
FIG. 4 is a partially cutaway side view of an embodiment with a double-plunger-pump pneumatic resister of linear motion.

Reference is made first to FIGS. 1–4. A pneumatic resister 1 of linear motion is a select type of pneumatic pressurizer that is operated linearly with pneumatic resistance of airflow through a design form of flow regulator with at least one inflow resister 2 and/or at least one outflow resister 3. Examples of select pneumatic resisters 1 are an accordion pneumatic resister 4 shown in FIG. 1, a telescopic pneumatic resister 5 shown in FIG. 2, a single-plunger pneumatic resister 6 shown in FIG. 3, and a double-plunger pneumatic resister 7 shown in FIG. 4. In a preferred embodiment as a chest exerciser, all pneumatic resisters 1 depicted in FIGS. 1–4 have a first hand grip member 8 and a second hand grip member 9 that are attached to end plates 10 or to plunger shafts 11, respectively, for separate types of pneumatic resisters 1 as illustrated. End walls 10 are preferred design walls of different types of pneumatic resisters for positioning of inflow resisters 2 and outflow resisters 3. Each of the embodiments of FIGS. 3 and 4 included an elongated plunger housing 6 and 7, respectively. In the embodiment of FIG. 3 a first plunger 11A is in sealed sliding contact with plunger housing 6, and in the embodiment of FIG. 4, a first plunger 11B and a second plunger 11C are in sealed sliding contact with plunger housing 7. In the embodiment of FIG. 3 a common air volume 6A, is enclosed by plunger housing 6, first plunger 11A, and common air volume closure member 10, which in this embodiment is the plunger housing end wall. In the embodiment of FIG. 4, a common air volume 7A, is enclosed by plunger housing 7, first plunger 11B, and common air volume closure member 11C, which in this embodiment is second plunger 11C.

Referring to FIGS. 5–7, a selection of flow-resistant means such as inflow resister 2 and outflow resister 3 are foreseeable. An inflow resister 2 can be a type that has an inlet valve 12 which seats against an inlet-valve seat 13 in a threaded inlet-adjustment sleeve 14 having an adjustment knob 15 that is preferably knurled. An inlet-valve spring 16 can be anchored in an inlet-orifice step 17. Inward threading of the inlet-adjustment sleeve 14 increases spring pressure against the inlet valve 12 to increase suction pressure required for volume expansion of whichever pneumatic resister 1 is employed for increasing pull resistance. The converse is employed for decreasing pull resistance. A sufficiently rigid inlet-valve spring 16 to function as a rigid sleeve converts inflow resistance from spring-operational mode to volume-operational mode because the inlet valve 12 then would be held rigidly at an adjusted distance from the inlet-valve seat 13. Spring-operational mode with a designedly lighter inlet-valve spring 16 is preferable because it is near totally pressure sensitive instead of near totally speed sensitive in comparison to volume-operational mode. The inlet-valve seat 13 surrounds an inlet-valve orifice 18 through which inflow air is directed to inlet orifice 19 in an end plate 10.

An outflow resister 3 can be a type that has an outlet valve 20 which seats against an outlet-valve seat 21 surrounding an outlet orifice 22 in the end plate 10. A threaded outlet-adjustment sleeve 23 has an outlet-valve orifice 24 surrounded by an outlet-spring step 25 against which an outlet spring 26 is anchored to apply opening pressure against the outlet valve 20 in accordance with threaded positioning of the outlet-adjustment sleeve 23. An adjustment knob 15 can be the same for both the inflow resister 2 and the outflow resister 3. Also like the inflow resister 2, volume-operational mode is achievable with a sufficiently rigid outlet spring 26 for the same reasons in reverse flow.

Referring to FIGS. 6–7, rotational indicia 27 and a pointer 28 on adjustment knobs 15 can be provided for fine-tune adjustment. Extra-fine threading of the inlet-adjustment sleeve 14 and the outlet-adjustment sleeve 23 is recommended for two reasons. First, it provides a lower cam angle for high positioning reliability. Second, it provides finer adjustment which is important because minute differences in valve openings make a big difference in airflow that affects pneumatic resistance. From the top, a uniformity of appearance of valves that are easy to set enhances product acceptance and marketing.

Referring to FIGS. 8–9, handles 8 and 9 can be attached to end plates 10 and to plunger shafts 11 with an attachment means, such as a quick-disconnect attachment 29, threaded attachments or other means. Other types of quick disconnect devices than the one depicted also can be employed. For example, a Luer connector that is used in the medical profession for syringes is good because it is particularly rigid. A plausible modification of a Luer connector would be a tapering of a connector shaft 30 and a matched tapering of a cylindrical receptor 31 that are shown straight as employed generally in mechanical fields. The tapering would be at distal ends of the connector shafts 30 and at proximal ends of the cylindrical receptors 31 beyond a lock pin 32 and a lock slot 33.

An attachment means such as a form of quick-disconnect attachment 29 allows use of body-connection components and body anchors such as body anchor 34 and multiple handles 8 and 9 on either end. Other body-connection components also can be attached to either or both ends of a pneumatic resister 1 with an attachment means that is standard for different handle and body-connection components. Foot straps 35 can be modified to be leg straps or shoulder attachments as optional types of body-connection components. Shoulder attachments, for instance, would permit shoulder and chest exercise independently of arm exercise when desired for chest buildup. Standardized attachment means opens this invention up to an equivalent of weight-lifting and pressing exercise simultaneously with adjustable resistance in opposite directions. This is a feat never before accomplished with such a convenient and highly versatile exerciser.

Figure 10:
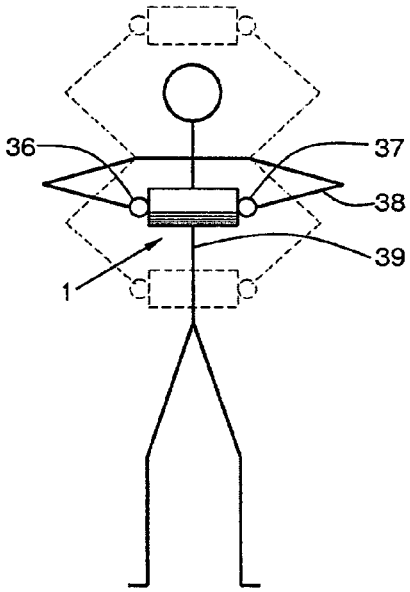
FIG. 10 is an elevation view of a stick representation of an exerciser using this invention for separate chest exercises.

Reference is made now to FIGS. 10–14 which depict stick figures of exercisers in relation to methods for using a pneumatic resister 1 having a first attachment 36 and a second attachment 37 that are either handles 8 and 9 or body anchors 34 as appropriate for particular methods of use. In FIG. 10, a method for exercising chest and arm muscles is outlined by arms 38 of an exerciser 39 grasping first attachments 36 and second attachments 37, which in this method would be handles 8 and 9, and then pushing and pulling the attachments 36 and 37 at arm heights which cause exercise of different parts of the exerciser's chest area. Different positions are shown in dashed lines.

Figure 11:
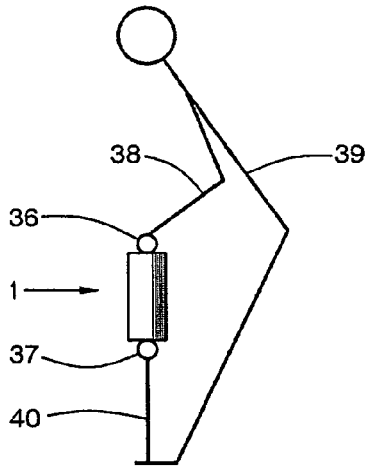
FIG. 11 is an elevation view of a stick representation of an exerciser using this invention for lifting and pressing exercises in a standing position.

In FIG. 11, a foot anchor 40 is attached to a second attachment 37 while a first attachment 36, preferably two handles 8 and 9 attached to a body anchor 34 as depicted in FIG. 8, is grasped for lifting and pressing exercise in a standing or variously upright position of the exerciser 39.

Figure 12:
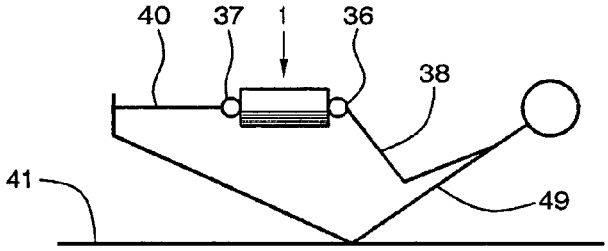
FIG. 12 is an elevation view of a stick representation of an exerciser using this invention for lifting and pressing exercises in a prone position.

In FIG. 12, similar methodical relationships are depicted as for FIG. 11, but with the exerciser 39 on a platform 41 such as an exercise pad or a bed to achieve different exercise effects for different types of people with different exercise objectives.

Figure 13:
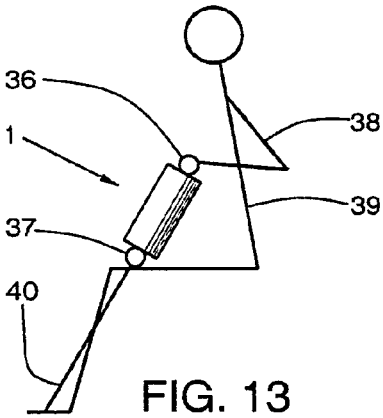
FIG. 13 is an elevation view of a stick representation of an exerciser using this invention for lifting and pressing exercises between feet and shoulders in a sitting position.

In FIG. 13, the exerciser 39 is sitting for selectively different exercising with components similar to those explained in relation to FIGS. 11–12.

Figure 14:
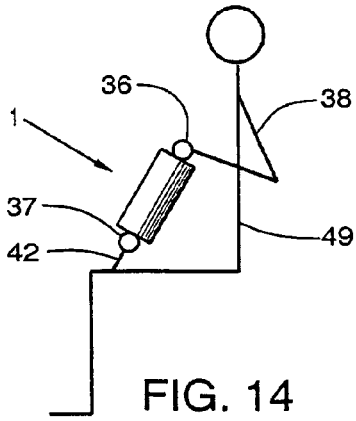
FIG. 14 is an elevation view of a stick representation of an exerciser using this invention for lifting and pressing exercises between knees and shoulders in a sitting position.

In FIG. 14, the exerciser 39 is sitting with a leg anchor 42 attached to the second attachment 37. Although shown with arms 38 in contact with the first attachment 36, the method shown here is particularly appropriate for a body anchor 34 shown in FIG. 8 for connection to shoulders of an exerciser 39 for chest exercise that is independent of arm and leg work.

Figure 15:
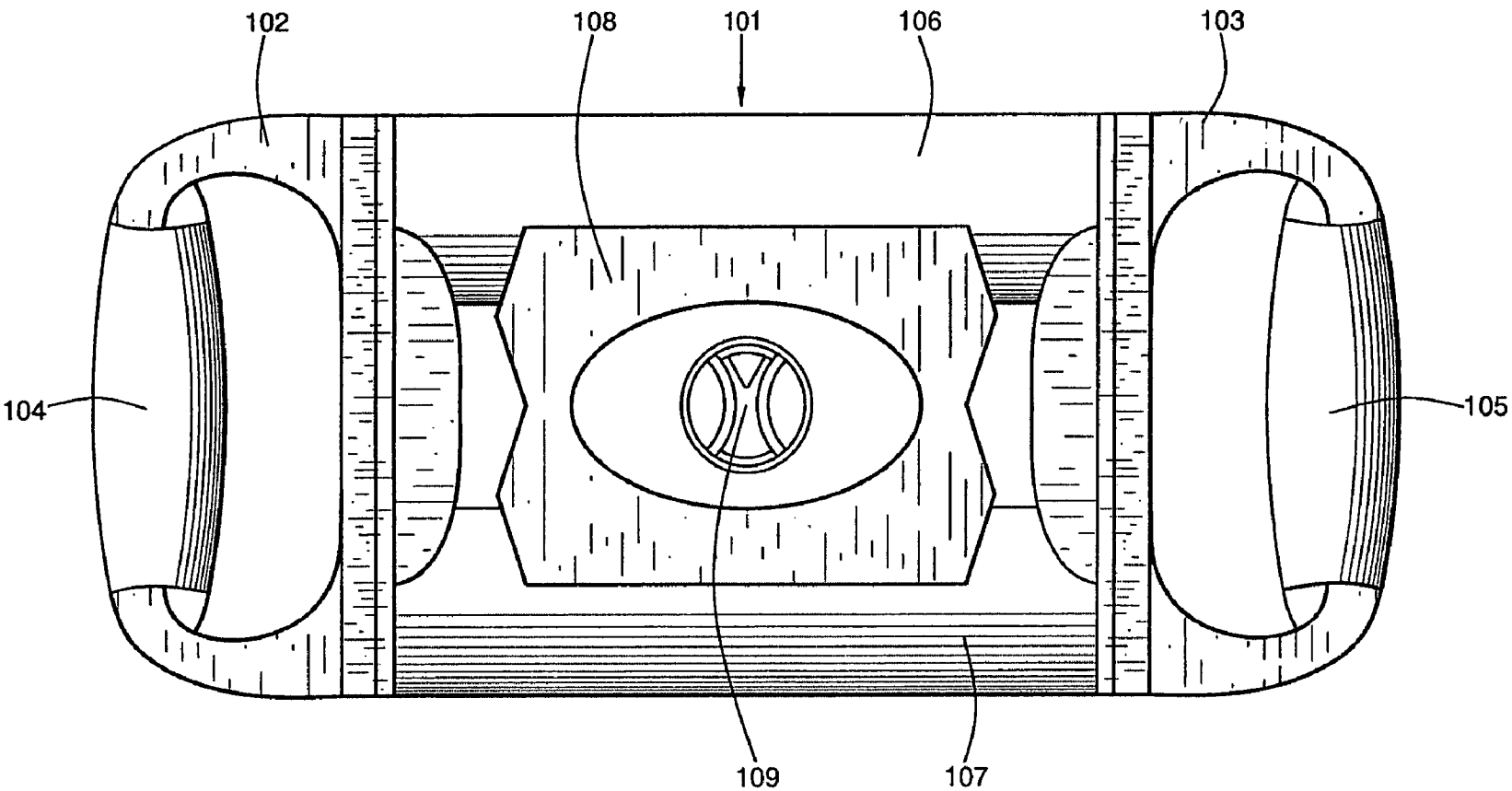
FIG. 15 is a side view of a dual cylinder pneumatic resister exercise device in the fully closed position.

In FIG. 15 a side view of the exterior of a single-action, double-plunger embodiment is shown having a fixed handle 102 with hand grip 104 on one end and a moveable handle 103 with hand grip 105 on the other end. The body of the device 101 has an upper cylinder 106 and a lower cylinder 107 connected by central section 108. A resister adjustment valve 109 in the central section 108 may be turned to adjust air flow through the valve, which in turn increases or reduces the pneumatic resistance when the moveable handle 103 is pulled outward from the body of the device 101. In other words, the more air that is vented out the valve 109 the less resistance there will be against the push or pull of a user's muscles. The valve 109 may be a standard petcock valve and have multiple positions such as high, medium or low depending on the resistance desired.

Figure 16:
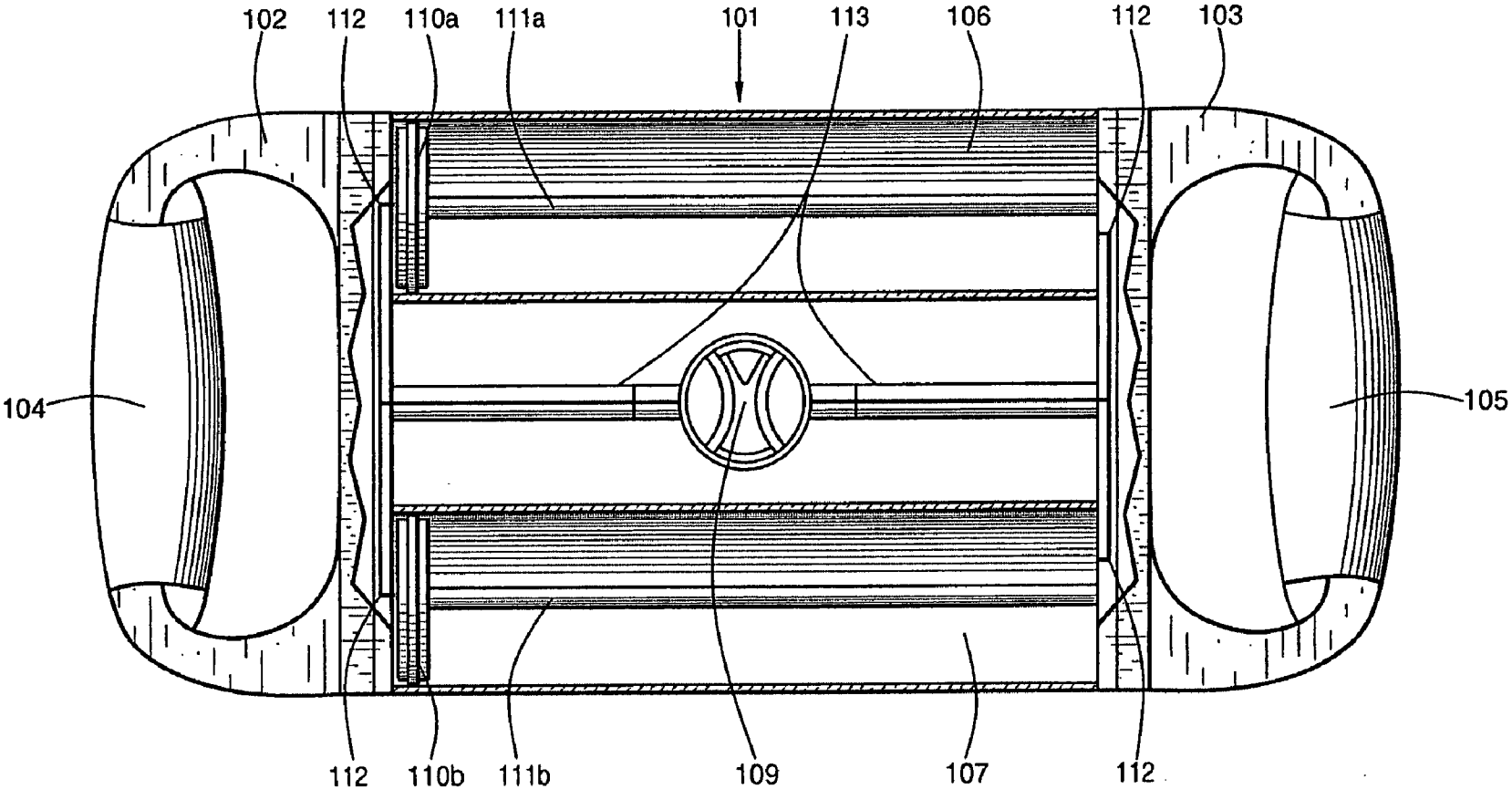
FIG. 16 is a side cut-away view showing a single action double plunger embodiment of the pneumatic resister exerciser device.

In FIG. 16 the internal workings of the single-action, double-plunger embodiment shown in FIG. 15 are shown. The upper cylinder 106 and lower cylinder 107 contain rods 111*a* and 111*b* with plungers 110*a* and 110*b* mounted on the ends thereof. Air vents 112 on each end adjacent to each handle are the central connecting air vent 113 allow compressed air to pass to the vent 109 for resistance adjustment purposes. In operation when the moveable handle 103 is pulled away from the body 101 the air behind the plunger is adjustably compressed to provide inward resistance against the muscles. Conversely, when the removable handle 103 is pushed inward from an extended outward position the air in front of the plungers 110*a* and 110*b* is also compressed and forced through the vent 109 to provide adjustable resistance.

Figure 17:
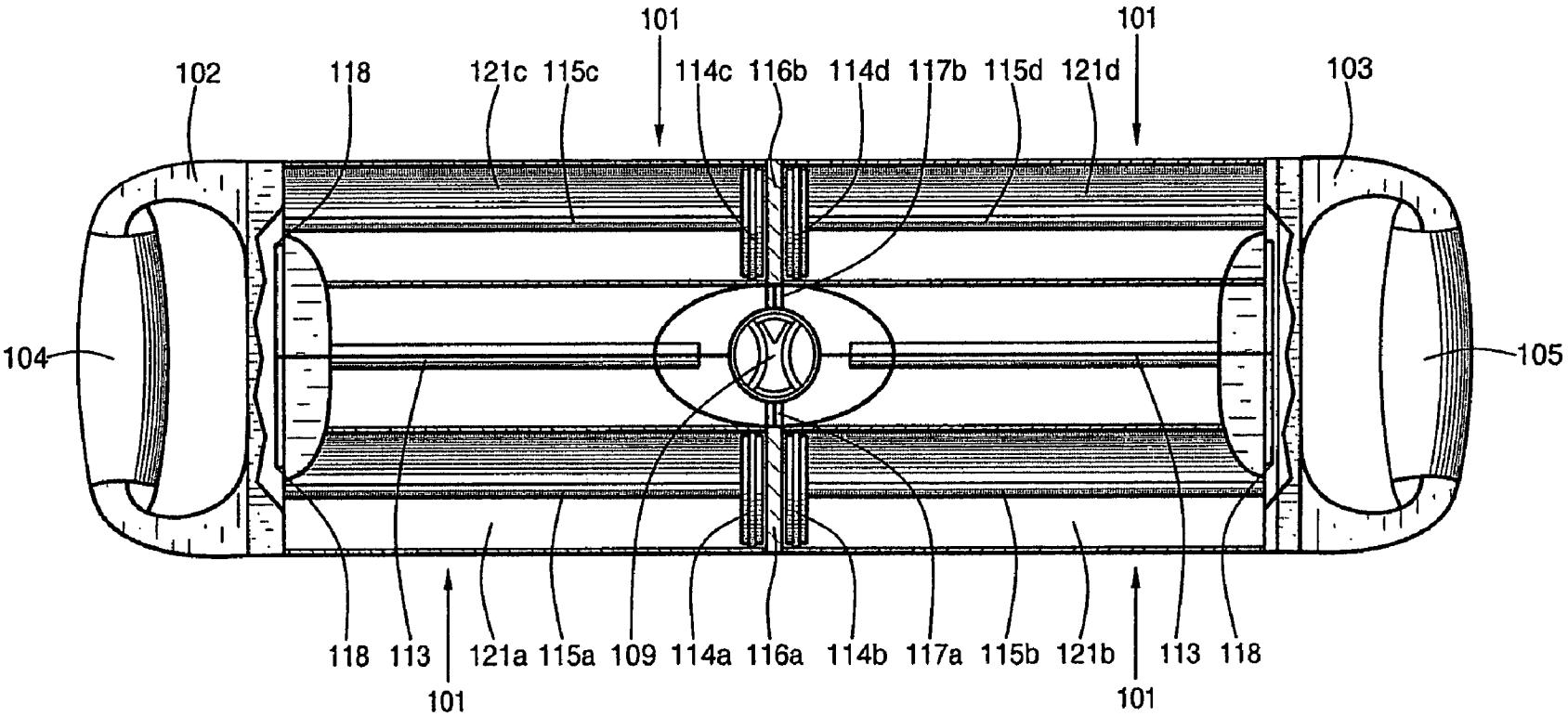
FIG. 17 is a side cut-away view of a double-action, double plunger embodiment of the pneumatic resister exercise device.

In FIG. 17 a double-action version of the pneumatic resister exercise device of the present invention is illustrated wherein both handles 102 and 103 may be simultaneously pulled outward away from the body 101 or conversely pushed inward simultaneously by wrapping the fingers around the grips 104 and 105. As illustrated, this version has top and bottom cylinders of the body split into four pneumatic sections, 121*a* and 121*b* on the bottom and 121*c* and 121*d* on the top, supported by central walls 116*a* and 116*b*. Each cylinder has a plunger 114*a*, 114*b*, 114*c* and 114*d* mounted on rods 115*a*, 115*b*, 115*c* and 115*d*. Central air vents 117*a* and end air vents 118 connected to central vent 113 are provided to allow air to be vented through central valve 109 to adjustably control the resistance of the device. In operation when the handles 102 and 103 are pulled outward away from the body 101, air behind the plungers 114*a*, 114*b*, 114*c* and 114*d* is compressed with air being vented out of the valve 109 through vents 118 and 113 depending on the adjustable setting of the valve 109. Conversely, when the handles 102 and 103 are pushed inward from an outward extension the air in front of the plungers

114*a*, 114*b*, 114*c* and 114*d* is compressed against the central walls 116*a* and 116*b* and vented out the valve 109 through central plunger vents 117*a* and 117*b*. Thus, in the latter manner this pneumatic exercise devices provides resistance in both directions, inward and outward, to exercise different muscles of the body, particularly the chest.

Figure 18:
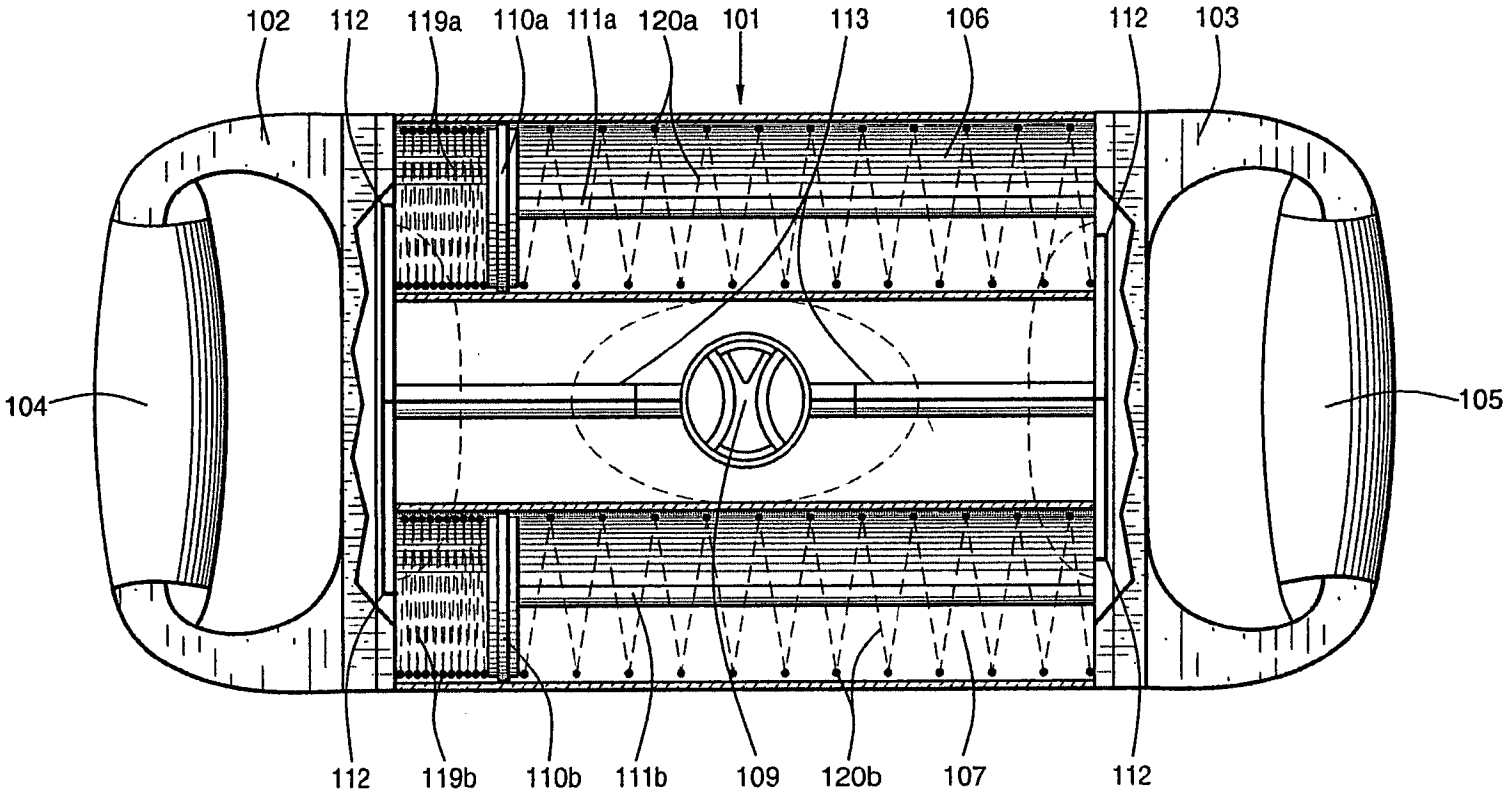
FIG. 18 is a side cut-away view of a spring assisted single-action, double-plunger embodiment of the pneumatic resister exerciser device.

In FIG. 18 the single-action embodiment of the present invention previously illustrated in FIGS. 15 and 16 are shown being assisted by springs 119*a* and 119*b* and 120*a* and 120*b*. Springs 120*a* and 120*b* behind the plungers 110*a* and 110*b* add resistance force when the handle 103 is being pulled outward from the body 101 of the device. Conversely, this resistance may be somewhat offset by the outward force of the springs 119*a* and 119*b* in front of the plungers 110*a* and 110*b*. Conversely, when the handles 103 are pushed inward toward the body 101 from an outward extending position, resistance is provided by the springs 119*a* and 119*b* in front of the plungers 110*a* and 110*b*. Although FIG. 18 shows springs both in front of and behind the plungers, either or any combination may be used with or without the central valve 109, which also acts to increase or decrease resistance.

Although FIGS. 15, 16, 17 and 18 showing single or double action using two or four cylinders, a plurality of cylinders with plungers could be utilized to achieve the pneumatic resistance provided by this device. In any event, these double plunger versions provide more stability for the exerciser not provided by a single plunger version described and illustrated in FIGS. 1–4 as the inward or outer pressure against the handles does not result in the transverse movement which could cause the pneumatic exercise device to fall from one's hands during use. Another embodiment of the pneumatic exercise device that is designed with handles that can be closely retracted and provide stability while exercising the breast muscles and enhancing the breast size of a user is described below.

Figure 19:
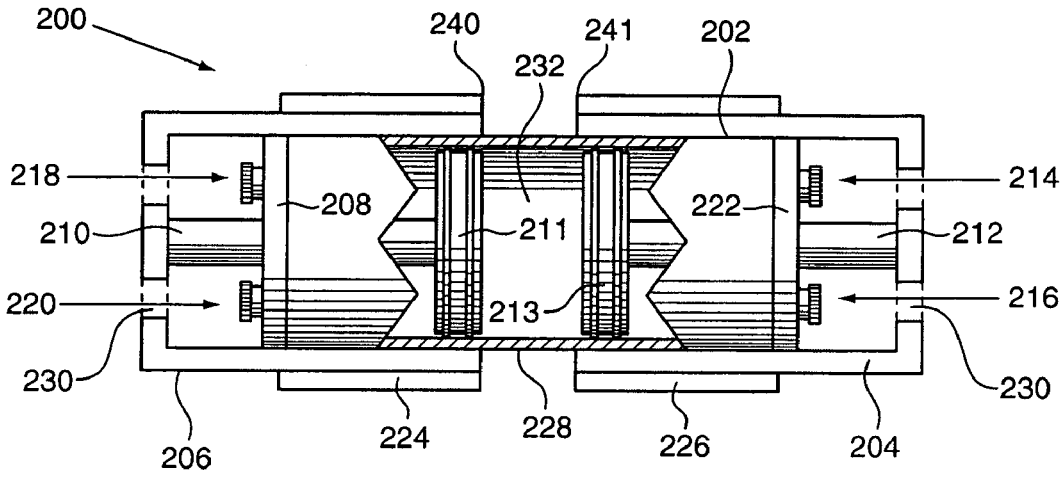
FIG. 19 is a partially cut-away side view of an embodiment with a double-plunger-pump pneumatic resister of linear motion with closely retracted handle locations.

In FIG. 19, a partially cutaway side view of another embodiment of the pneumatic exercise device is shown. Double-plunger-pump pneumatic resister 200 includes a first plunger hand grip member 206 and a second plunger hand grip member 204 wherein a cross-section of the members 206 and 204 form a circle, or alternatively, other geometric shapes such as ovals, pentagons, hexagons, hectagons, octagons or squares. A first handle 224 and a second handle 226 provide a grasping surface for the first plunger hand grip member 206 and the second plunger hand grip member 206, respectively. The first handle 224 and second handle 226 are made from a foam material, or alternatively, other compressible or non-compressible material such as plastic, Styrofoam, rubber, sponge, foam rubber or sponge rubber.

The double-plunger-pump pneumatic resister 200 also includes a plunger housing 228 that contains a first plunger 211 and a second plunger 213. The first plunger 211 is attached to the first plunger hand grip member 206 by plunger connector 210 at the distal end of the first plunger assembly. Also, the second plunger 213 is attached to the second plunger hand grip member 204 at the distal end of the second plunger 212. Both the first plunger hand grip member 206 and the second hand grip member 204 include holes 230 to allow air flow. The plunger housing 228 is enclosed at one end by a first end wall 208 and at the other end by a second end wall 222. Both first end wall 208 and second end wall 222 have holes to allow for the first plunger 212 and second plunger 210, respectively, to move through. Preferably, the first end wall 208 includes a first adjustable inlet vent 218 and a first adjustable outlet vent 220, and the second end wall 222 includes a second adjustable inlet vent 214 and a second adjustable outlet vent 216 to allow the user to set the desired airflow resistance of the pneumatic exerciser device. In this embodiment, a common air volume 232, is enclosed by plunger housing 228, first plunger 211, and common air volume closure member 213, which in this embodiment is second plunger 213. This embodiment of the pneumatic exercise device is designed with handles that can be closely retracted and provide stability while exercising the breast muscles and enhancing the breast size of a user. When the pneumatic exerciser device is in a fully retracted position, there is a retracted grip distance between the proximal end 240 of the first plunger hand grip member 224 and the proximal end 241 of the second plunger hand grip member 226. This retracted grip distance is preferably between 0 and 10 inches. Preferably, the retracted grip distance is between 1 and 5 inches.

Figure 20:
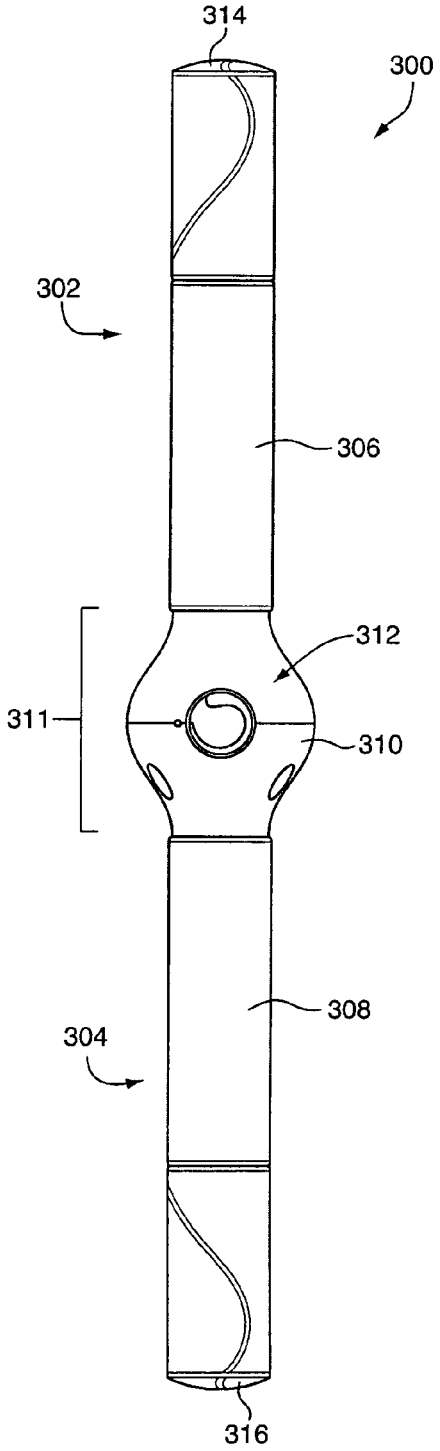
FIG. 20 is front view of a double-plunger embodiment of the pneumatic resister exerciser device with closely retracted handle locations and adjustable vent.

FIG. 20 is a front view of another embodiment of the pneumatic exerciser device in a fully retracted position. The double-plunger-pump pneumatic resister 300 includes a first plunger hand grip member 302 and a second plunger hand grip member 304. The first plunger hand grip member 302 includes a first handle 306 and a first end cap 314 and the second plunger hand grip member 304 includes a second handle 308 and a second end cap 316. When the pneumatic exerciser device is in a fully retracted position, there is a retracted grip distance 311 between the proximal end of the first plunger hand grip member 302 and the proximal end of the second plunger hand grip member 304. This retracted grip distance 311 is preferably between 0 and 10 inches. Preferably, the retracted grip distance 311 is between 1 and 5 inches.

Figure 21:
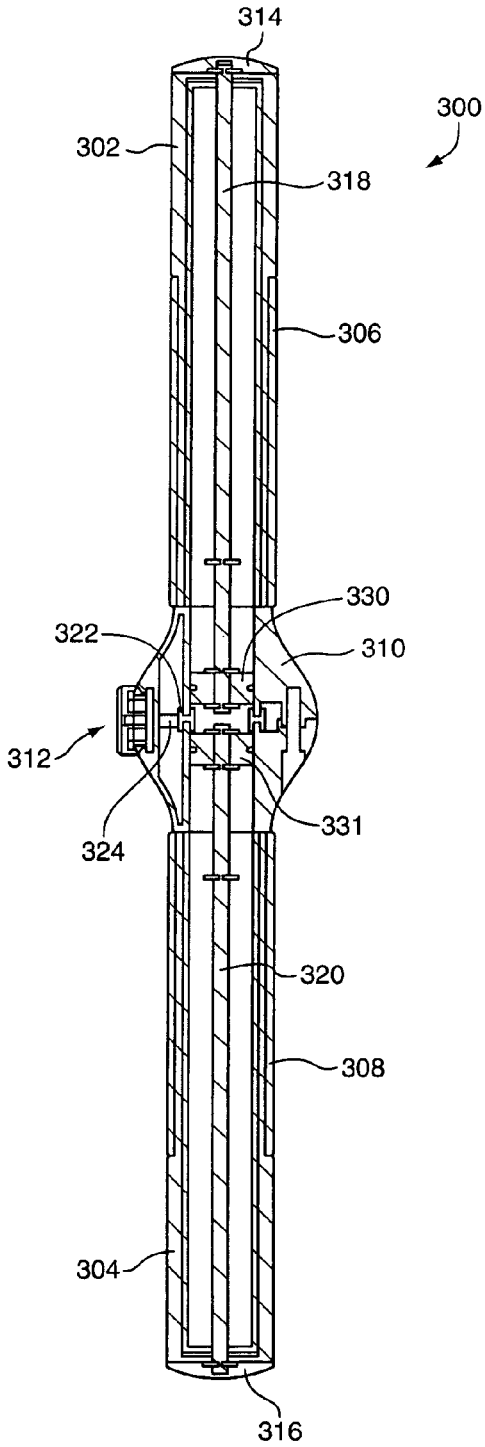
FIG. 21 is a side cut-away view of a double-plunger embodiment of the pneumatic resister exerciser device with closely retracted handle locations and adjustable vent.
Figure 25:
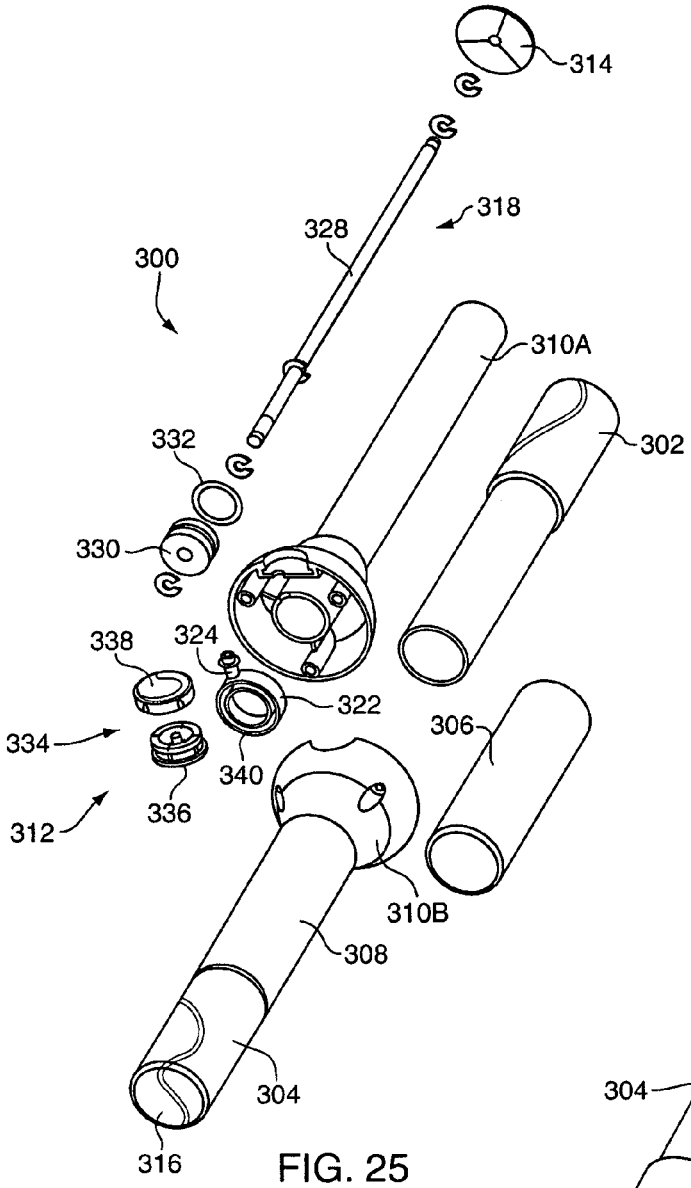
FIG. 25 is an exploded view of a double-plunger embodiment of the pneumatic resister and adjustable vent.

The double-plunger-pump pneumatic resister 300 further includes an elongated plunger housing 310 including a flared vent housing 319 which encloses an adjustable vent 312. A side cut-away view of double-plunger-pump pneumatic resister 300 is shown in FIG. 21. In addition to the parts described above in FIG. 20, FIG. 21 depicts a first plunger 330 and a second plunger 331 in sealed sliding contact with the elongated plunger housing 310. Here "sealed" sliding contact means that, as it slides, the plunger is in suitable contact with the housing so that air or other fluid cannot circumvent the plunger by escape where the plunger contacts the housing, but rather is pushed by the plunger as it moves. Of, course, in the real physical world, every plunger is to some extent imperfect, and thus this term includes plungers in which there may be an insignificant amount of air or other gas that leaks through the plunger seal. Also shown is an optional recessed area 307, perhaps best shown in FIG. 25, in the first plunger hand grip member 302 and the second hand grip member 304 to allow the first handle 306 and the second handle 308 to be flush with the first plunger hand grip member 302 and the second plunger hand grip member 304, respectively. The elongated plunger housing 310 may be a one-piece assembly or a multi-piece assembly. When the elongated plunger housing 310 is a two-piece assembly, as shown in FIGS. 21 and 25, a seal 322 is placed between the proximal ends, such as 321 (FIG. 25) to seal the elongated plunger housing 310. The seal 322 includes a channel 324 to communicate airflow between the seal and the adjustable vent 312. The first plunger hand grip member 302 and the second plunger hand grip member 304 move between fully retracted positions and fully extended positions.

Figure 22:
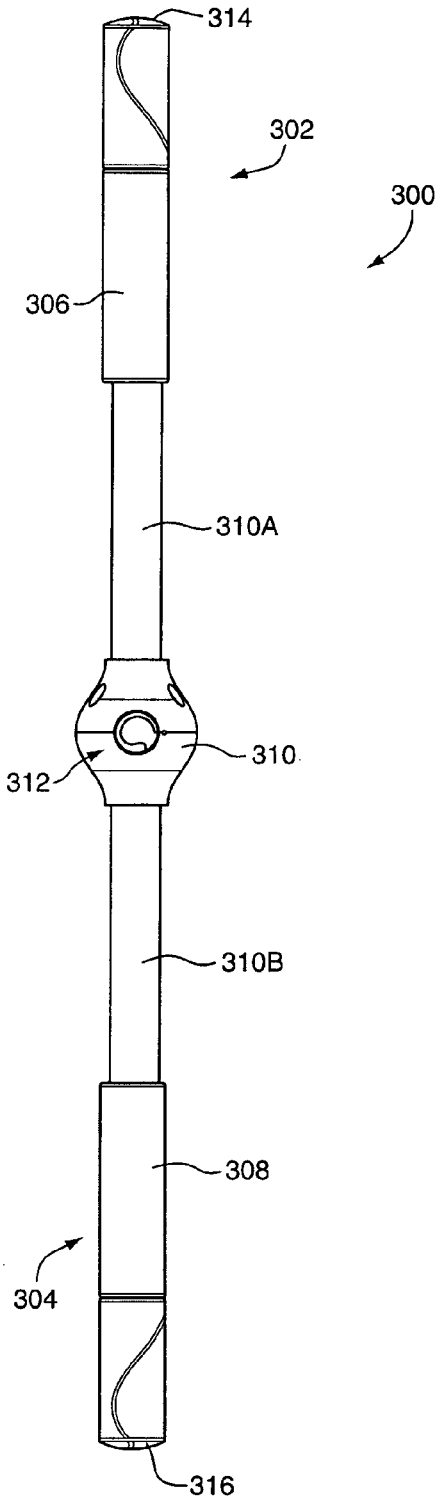
FIG. 22 is a front view of a double-plunger embodiment of the pneumatic resister exerciser device with extended handle locations and adjustable vent.
Figure 23:
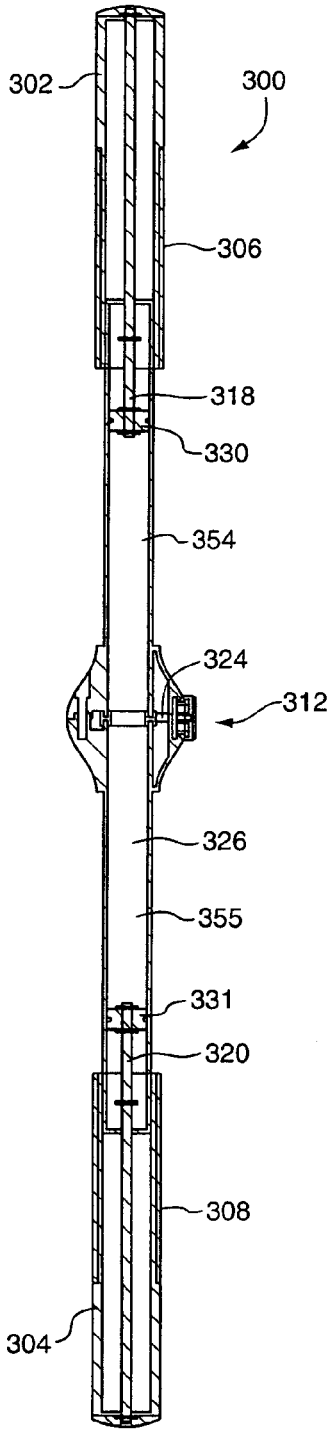
FIG. 23 is a side cut-away view of a double-plunger embodiment of the pneumatic resister device with extended handle locations and adjustable vent.
Figure 24:
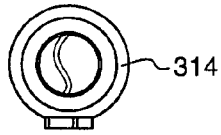
FIG. 24 is an end view of a double-plunger embodiment of the pneumatic resister device with adjustable vent.

In FIG. 22, a front view is shown of the double-plunger-pump pneumatic resister 300 in a fully extended position revealing a first end 310A and a second end 310B of the two-piece elongated plunger housing 310. The first plunger hand grip member 302 and the second plunger hand grip member 304 are shown extended distally relative to the center of the elongated plunger housing 310. In FIG. 23, the common air volume 326 is shown between the first plunger 330 and the common air volume closure member 331, which in this embodiment is the second plunger 331. The common air volume 326 increases in size as the first plunger 330 and second plunger 321 are moved away from each other and, conversely, decreases in size as the first plunger 330 and second plunger 331 are moved toward each other. As the user moves the first plunger hand grip member 302 and the second plunger hand grip member 304 away from each other, air is introduced into the common air volume 326 via the adjustable vent 312 creating a resistive motion for the user to overcome. Conversely, as the user moves the first plunger hand grip member 302 and the second plunger hand grip member 304 toward each other, air is evacuated from the common air volume 326 via the adjustable vent 312 creating a resistive motion for the user to overcome. In FIG. 24, the double-plunger-pump pneumatic resister 300 is shown from an end view revealing a front view of the first end cap 314. The double-plunger-pump pneumatic resister 300 includes several internal parts that are interrelated to the resistive force and are described below.

In FIG. 25, an exploded view of the double-plunger-pump pneumatic resister 300 is shown. A two-piece elongated plunger housing 310 is shown as separated in the middle, depicting the first housing member 310A and the second housing member 310B which together comprise the two-piece elongated plunger housing 310. Both the first housing member 310A and the second housing member 310B include at least one vent hole 317 (FIG. 24A) located at the distal end of the respective housing member to vent pressure created between the plunger, such as 330, and the distal end 325 of the respective housing member. The first housing member 310A, second housing member 310B, the first plunger hand grip member 302 and the second plunger hand grip member 304 can be made of plastic, or alternatively, by other rigid material such as steel, aluminum, metal, carbon, plexiglass or fiberglass. The first housing member 310A and the second housing member 310B are connected by a seal 322 that seals the two housing members creating the common air volume 326. In an alternative embodiment this seal can be a divider which divides the air volume into separate volumes 354 and 355.

Seal 322 preferably includes an O-ring groove 340. The O-ring groove 340 can be on one or both sides of the seal 322 and accepts an O-ring for sealing the first housing member 310A and second housing member 310B when they are positioned together to form the elongated plunger housing 310. The first housing member 310A contains the first plunger 331 in sealed slideable contact. The first plunger assembly includes a first plunger connector shaft 328, a first plunger 330 and a first plunger end O-ring 332. The second housing member 310B contains the second plunger 331 in sealed slideable contact. The second plunger assembly includes the same structure and parts as the first plunger assembly and will not be described. The adjustable vent 312 includes a knob 334 that enables the user to adjust the pneumatic resistance of the double-plunger-pump pneumatic resister 300. The knob 334 allows the user to increase or decrease the resistive force of the double-plunger-pump pneumatic resister 300.

Figure 26:
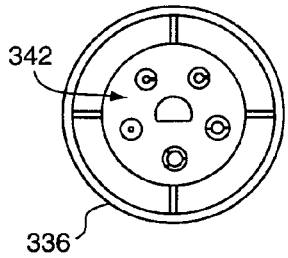
FIG. 26 is a front view of the vent member depicting a plurality of holes therein.
Figure 27:
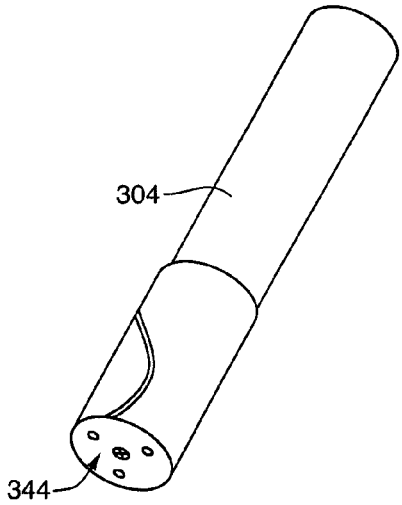
FIG. 27 is a perspective end view of plunger hand grip member depicting vent holes therein.

The adjustable vent 312 includes a vent member 336 attached to a knob 334. The vent member 336 and knob 334 are attached to each other and rotate together to adjust airflow resistance of the double-plunger-pump pneumatic resister 300. The knob 334 is in communication with the seal 322 via channel 324. In FIG. 26, a front view of the vent member 336 is shown depicting a plurality of varying sized vent member holes 342. The vent member holes 342 are located around the perimeter of the vent member 336. The channel 324 is tangentially offset from the middle of the seal to conform to the location of at least one of the vent member holes 342. As the knob 334 is rotated or selected by the user, a corresponding vent member hole 342 is selected, which comes in communication with the channel 324, thereby creating greater or lesser pneumatic resistive force through the adjustable vent 312. In FIG. 27, a perspective view of the second plunger hand grip member 304 is shown with the second end cap 316 removed to expose at least one second plunger hand grip member vent hole 344. As mentioned above, the first plunger hand grip member 302 includes at least one first plunger hand grip member vent hole and the second plunger hand grip member 304 includes at least one second plunger hand grip member vent hole. The first end cap 314 and second end cap 316 are supported from their respective plunger hand grip members by ribs 315 (FIG. 25), or alternatively, other such devices to allow for airflow between the end caps 314 and 316 and their respective plunger hand grip members 302 and 304. At the distal end, such as 325, or each plunger housing, such as 310, the end cap 314 is supported by the plunger hand grip member, such as 304, and the plunger connector shaft, such as 328, to create an air passage way for venting the plunger hand grip member vent hole 344 and the at least one housing vent hole 317. The system 300 is held together by screws that screw into bosses, such as 323, within flared vent housing 319.

The present invention includes a system for enhancing the size of a breast of the user. The system includes the use of an exerciser as described herein in combination with a breast nutrient compound, such as pueraria mirifica, a known natural plant estrogen.

As is known in the art, some nutrient compounds, such as pueraria mirifica, can enhance breast growth of a user. Pueraria mirifica is a natural plant estrogen, also known as phytoestrogens, which are constituents that bind to estrogen receptors and have other effects similar to estrogen in the body. They are not truly estrogens, since their chemical forms are different from estrogen. These phytoestrogens do have estrogen-like effects that can be very helpful for the growth of breast cells. Estrogen is a natural body substance that affects the human body characteristics, including growth and maintenance of all female sex characteristics. The deficiency of estrogen in the body can cause menopause, sagging breasts, wrinkled skin and bone loss.

Pueraria mirifica can lengthen the milk ducts of a breast and stimulate and expand the fat tissues, resulting in firmer breasts. Pueraria mirifica can also maintain collagen, develop new skin cells, which can both contribute to soft, smooth and beautiful breasts. The active ingredients in these pueraria mirificas include miroestrol, pueraria, mirifica, daidazein, B-sitistirol, soumestrol, genistein and genisten. The pueraria mirifica can be delivered to the breast area via various mechanisms including ingesting herbal foods, ingesting pills, application of crèmes, application of tonics and application of pastes.

The pueraria mirifica can be applied directly onto the breast of a user via a crème or tonic. Also, the pueraria mirifica can be taken orally, including by herbal foods and pills. The pueraria mirifica promotes fibroblasts in normal breast cells. The pueraria mirifica stimulates fibroblasts that produce collagen tissues or glands. Working together, the pueraria mirifica and the pneumatic exerciser embody an effective system that can increase the breast size of a user. This system offers the user a plethora of methods in which to enhance the size of the user's breast. One such embodiment is to apply pueraria mirifica crème directly to the breast of a user followed by a regimen of alternating extending and retracting forces applied to the pneumatic exerciser by the user. For stronger users, the knob 334 is selected to a more resistive force, and conversely for less strong users, the knob 334 is selected to a less resistive force. This method of using the pueraria mirifica and pneumatic exerciser system can be repeated several times a day for improved results.

Another embodiment method for enhancing the breast size of a user involves ingesting a pill containing the pueraria mirifica followed by the above stated regimen of alternating extending and retracting forces applied to the pneumatic exerciser by the user. In addition, a further embodiment involves digesting herbal foods that contain pueraria mirifica followed by the above stated regimen of alternating extending and retracting forces applied to the pneumatic exerciser by the user.

A feature of the invention is the close proximity of the handles, such as 8, 9, 224, 226, 306, 308, particularly in the embodiments of FIGS. 4, and 19–27, which focuses the exercise at the breast area of the user. This proximity is enhanced by the fact that the exerciser utilizes a common air volume, thereby eliminating parts that force the handles to be further apart. This is also enhanced by the fact the handles, such as 224, 226, 306, 308 slide on and are coaxial with the plunger housing, such as 228, 310A and 310B. This focus of the exerciser on the breast area in combination with the use of a breast nutrient compound provides a synergistic effect that is not available with any prior art breast enhancement system.

A new and useful chest exerciser having been described, all such modifications, adaptations, substitutions of equivalents, combinations of parts, pluralities of parts, applications and forms thereof as described by the following claims are included in this invention.

The invention claimed is:

1. An exercise device comprising:

an elongated plunger housing having a first end and second end;

a first hand grip member and a first plunger, said first hand grip member connected to said first plunger; and a second hand grip member and an air volume closure member, said second hand grip member connected to said second plunger;

said first plunger in sealed sliding contact with said plunger housing;

a common air volume enclosed by said plunger housing, said first plunger, and said second plunger;

said exercise device further comprising an adjustable vent for venting said plunger housing; and said exercise device sized and shaped to be hand-held by an individual for exercising.

2. An exercise device as in claim 1 wherein said second plunger is located on the opposite side of said common air volume from said first plunger.

3. An exercise device as in claim 1 wherein said adjustable vent includes a first adjustable vent for venting said first end of said plunger housing and a second adjustable vent for venting said second end of said plunger housing.

4. An exercise device as in claim 3 wherein said adjustable vent communicates with said common air volume.

5. An exercise device as in claim 4 wherein said adjustable vent is located centrally to said elongated plunger housing.

6. An exercise device as in claim 5 wherein said adjustable vent comprises a vent member attached to a knob and a channel communicating with said common air volume, said vent member having a plurality of holes of different sizes, said channel and vent member arranged so that as said knob is turned, a different one of said holes aligns with said channel.

7. An exercise device comprising:

an elongated plunger housing having a first end and second end;

a first band grip member and a first plunger; said first band grip member connected to said first plunger; and a second band grip member and an air volume closure member, said second hand grip member connected to said air volume closure member;

said first plunger in sealed sliding contact with said plunger housing;

a common air volume enclosed by said plunger housing, said first plunger, and said air volume closure member;

said exerciser sized and shaped to be band-held by an individual for exercising wherein said first hand grip member and said second hand grip member move relative to each other between a fully extended position and a fully retracted position, and wherein in said fully retracted position the retracted grip distance between the proximal end of said first hand grip member and the proximal end of said second hand grip member is between 0 and 10 inches.

8. An exercise device as in claim 7 wherein said retracted grip distance is from 1 and 5 inches.

9. An exercise device as in claim 1 wherein said elongated plunger housing comprises two housing members joined by a seal.

10. An exercise device as in claim 1 wherein said elongated plunger housing includes a vent hole in said elongated plunger housing.

11. An exercise device as in claim 1 wherein said plunger hand grip members each include a plunger hand grip member vent hole.

12. An exercise device comprising:

a first hand-held reciprocating member comprising a first proximal end and a first distal end;

a second hand-held reciprocating member comprising a second proximal end and a second distal end, wherein when said device is in a fully retracted position the first proximal end and second proximal end define a retracted gap distance of from 0 to 10 inches; and a two-way resistive force member for generating a force that opposes reciprocating movement of said first hand-held reciprocating member and said second hand-held reciprocating member, in response to the reciprocating movement of said first hand-held reciprocating member and said second hand-held reciprocating member.

13. An exercise device as in claim 12 wherein said retracted grip distance is from 1 and 5 inches.

14. An exercise device as in claim 12 wherein said two-way resistive force member includes a piston disposed in a cylinder.

15. An exercise device comprising:

an elongated plunger housing having a first end and second end;

a first plunger and a first plunger hand grip, said first plunger hand grip member connected to said first plunger;

a second plunger and a second plunger hand grip member, said second hand grip member connected to said second plunger;

said first plunger in sealed sliding contact with said first end of said plunger housing and said second plunger in sealed sliding contact with said second end of said plunger housing with said first and second plungers opposed on opposite sides of an air volume with said plunger housing;

said exerciser sized and shaped to be hand-held by an individual for exercising.

16. An exercise device as in claim 15 wherein said air volume comprises a common air volume.

17. An exercise device as in claim 15 wherein said air volume comprises a first air volume adjacent said first plunger and a second air volume adjacent said second plunger, and said device further includes a divider wall between said first air volume and said second air volume.

* * * * *